United States Patent [19]

House

[11] 4,332,520

[45] Jun. 1, 1982

[54] VELOCITY PUMP REACTION TURBINE

[75] Inventor: Palmer A. House, Walnut Creek, Calif.

[73] Assignee: The United States of America as represented by the United States Department of Energy, Washington, D.C.

[21] Appl. No.: 98,450

[22] Filed: Nov. 29, 1979

[51] Int. Cl.[3] ..... F01D 1/18

[52] U.S. Cl. ..... 415/63; 415/80

[58] Field of Search ..... 415/63, 80, 81, 82; 60/649

[56] References Cited

U.S. PATENT DOCUMENTS

| | | | |
|---|---|---|---|
| 653,788 | 7/1900 | Brady | 415/63 |
| 1,079,177 | 11/1913 | Jones | 415/63 |
| 2,596,276 | 5/1952 | Napoli | 415/80 |
| 3,828,553 | 8/1974 | Eskeli | 415/80 |
| 4,063,417 | 12/1977 | Shields | 60/641 |
| 4,086,766 | 5/1978 | Stieger | 60/330 |
| 4,141,219 | 2/1979 | Frosch | 60/645 |

*Primary Examiner*—Louis J. Casaregola

*Attorney, Agent, or Firm*—L. E. Carnahan; Roger S. Gaither; Richard G. Besha

[57] ABSTRACT

An expanding hydraulic/two-phase velocity pump reaction turbine including a dual concentric rotor configuration with an inter-rotor annular flow channel in which the inner rotor is mechanically driven by the outer rotor. In another embodiment, the inner rotor is immobilized and provided with gas recovery ports on its outer surface by means of which gas in solution may be recovered. This velocity pump reaction turbine configuration is capable of potential energy conversion efficiencies of up to 70%, and is particularly suited for geothermal applications.

6 Claims, 9 Drawing Figures

VELOCITY PUMP REACTION TURBINE

BACKGROUND OF THE INVENTION

The invention described herein is a result of work performed at Lawrence Livermore Laboratory under Contract W-7405-ENG-48 between the U.S. Department of Energy and the University of California.

The invention relates generally to a method and apparatus for converting the stored energy of a hot stream of fluid into mechanical work. More particularly, this invention relates to velocity pump reaction turbines utilized in the extraction and conversion of energy from a hot, saturated or compressed stream of fluid into turbine shaft work.

As the world's demand for energy increases simultaneously with the decrease in available fossil fuels, various alternative sources of energy have become the subject of intense investigation. One of these areas of investigation is concerned with the recovery of energy from geothermal energy sources. A promising approach to exploiting this source of energy involves the use of turbomachinery to convert the stored energy of a geothermal water deposit to rotational mechanical energy from which electrical power can be produced. Until recently, turbine prime movers using water as the working fluid were developed as either vapor or hydraulic turbines. Because fossil fuels were heretofore readily available to produce the high temperature heat of vaporization needed for economical binary cycles or Rankine cycles, little attention was paid to processes and turbomachinery for the direct expansion of hot water. The development of turbines in the area of geothermal energy recovery applications has therefore been based on the Rankine cycle and on high operating temperatures. Now, however, with increasing energy consumption and dependence upon fossil fuels, means are being sought to also exploit low and medium temperature fluids, which may arise either as geothermal water deposits or as waste heat sources. For the rare case of vapor-dominated geothermal sources, conventional steam turbines suffice. However, for the more abundant hydrothermal reservoirs in which the wellhead products range from totally liquid (hot water) to a two-phase mixture that is mainly liquid (80% or more of the mass flow rate), there is a need for a turbine that can expand hot water directly. A turbine capable of exploiting lower temperature geothermal reservoirs could also be used for power production from industrial waste heat, which exists mainly in the form of hot liquids or gases too low in temperature to drive a binary or Rankine cycle economically.

Geopressured geothermal resources, although a potentially very large energy source, at present represent a somewhat economically questionable central station power producer. This unresolved issue is due primarily to (1) the great depth at which these reservoirs are located (as deep as 15,000 feet), and (2) the high pressures downhole which may be a great as 10,000 psia. The economics of exploiting these low (~150° C.) temperature reservoirs with the associated high well costs changes, however, due to the possibility of large quantities of dissolved methane being present therein. Geopressured resources, therefore, should be thought of as fossil energy—not geothermal—resources. If the resource is developed for natural gas, geothermal energy becomes a by-product. Consequently, it will be important to develop a low-cost, efficient energy conversion system specifically suited for utilizing low-temperature geothermal energy components.

One approach to using a turbine for extracting energy from two-phase fluids, such as steam and water, is the subject of U.S. Pat. No. 4,141,219, issued Feb. 27, 1979, to Elliot. Disclosed therein is a turbine having a plurality of nozzles through which a two-phase fluid is delivered to the turbine housing which contains a plurality of concentrically related annuli and axially related passages. By means of a phase separator mounted internal to the turbine, the liquid phase is delivered to one of the endless annular channels, while the vapor phase is directed along the axial passageways. The thus separated phases of the fluid are then directed through mutually independent turbine blades for simultaneously extracting kinetic energy from both phases of the fluid. This configuration thus permits the simultaneous recovery of kinetic energy from both the liquid and vapor phases with a relatively simple turbine design, which is a significant improvement in this area. However, this turbine requires a high temperature two-phase fluid source.

Similarly, U.S. Pat. No. 4,063,417, issued Dec. 20, 1977, to Shields, describes an energy recovery system employing a geothermally heated fluid from which the liquid and vapor constituents are separated and permitted to drive liquid and vapor turbines, respectively. Although extracting energy from both components of the heated fluid and thus representing a very efficient energy recovery mechanism, this system is designed to operate with high temperature (350° F. to 600° F.) geothermal reservoirs.

At low to medium temperatures (~180° C.), there are several candidate two-phase expanders, the most promising being the pure reaction turbine for expanding saturated and compressed liquids.

One object of the present invention is to provide a more efficient turbine for extracting energy from low and medium temperature geothermal and waste heat energy sources by reducing the absolute velocity of the exiting fluid, thus reducing exit loss.

Another object of the present invention is to provide an improved method of direct recovery of a gas in solution in a hot fluid, in combination with the extraction of energy from the fluid itself.

Still another object of the present invention is to provide a more reliable, compact and practical energy recovery turbine by reducing turbine shaft speeds, and by operatively connecting the two turbine rotors so that one rotor is driven by the other.

Still another object of the present invention is to provide a turbine capable of converting large percentages of the stored energy of a hot liquid into mechanical energy without having to separate the two phases, and discard the water phase without recovering energy therefrom.

Still another object of the present invention is to provide a velocity pump reaction turbine which includes two concentrically positioned rotors, with the inner rotor containing a velocity pump which is mechanically driven by the outer rotor, and with the two rotors being separated by an annular flow channel, in which the fluid is held at its saturation pressure.

Still another object of the present invention is to provide a hydraulic/thermal reaction turbine for the expansion of a hot compressed liquid combination which includes a fixed, circular liquid nozzle assembly through which the fluid from which energy is to be recovered flows into an annular space surrounded by a reaction turbine rotor, with the surface of the inner nozzle assembly possessing gas recovery ports for the direct recovery of gas in solution in the liquid.

Other objects and advantages of the invention will become apparent from the following drawings and detailed description of the present invention.

SUMMARY OF THE INVENTION

The present invention is a method and apparatus for more efficient extraction of energy from a two-phase expansion of a saturated or compressed fluid, and converting it to turbine shaft work by means of a new velocity pump reaction turbine. By concentrically positioning two rotors which are driven by a hot, saturated or compressed fluid passing from the inner rotor to the outer rotor through a fluid flow channel in which the fluid is reduced to its saturation pressure, the outer rotor can be used to drive the inner velocity pump rotor, thereby resulting in high fluid energy extraction efficiency.

The present invention provides a continuous fluid flow channel between a concentrically positioned inner velocity pump and an outer turbine while the inner pump is driven by means of the outer turbine. This permits lower operating shaft speeds than currently available, thereby reducing component wear and exit loss. The invention converts the energy of an expanding liquid to turbine shaft work at potential efficiencies of 50–70% with overall power output increased by approximately 15–20%. This could result in a reduction of power costs by at least 10% for an increase in capital costs of only about 3%.

BRIEF DESCRIPTION OF THE DRAWINGS

The invention will be described in greater detail by reference to the drawings, in which.

DESCRIPTION OF PREFERRED EMBODIMENTS

The preferred embodiment of the invention is a velocity pump reaction turbine (VPRT) which is particularly useful in extracting hydraulic and thermal energy from a hot fluid stream, such as water, as may be found in a geothermal energy source. Because of its unique design, the subject invention is capable of operating at efficiencies of up to 70% with even low to medium temperature (180° C.) geothermal reservoirs. However, it is to be pointed out that this turbine has utility separate and apart from such energy sources and, because of its capability to operate efficiently with relatively low-temperature energy sources, may be used with various energy reservoirs such as an industrial waste heat recovery system, where the waste heat exists or is gathered mainly in the form of hot liquids.

Figure 1:
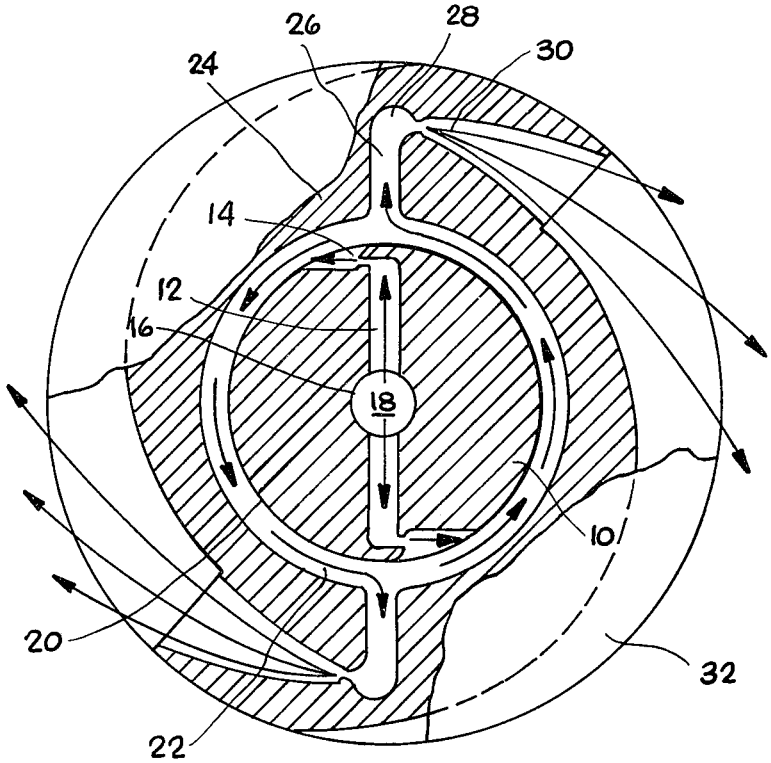
FIG. 1 is a cutaway cross-sectional view of the velocity pump reaction turbine.

The velocity pump reaction turbine, shown in FIG. 1 in a cutaway cross-sectional view perpendicular to the rotor shafts, has an inner rotor 10 with two or more radial passageways 12, each terminating in a liquid nozzle 14 on the periphery of the inner rotor 10. A flowing fluid enters the turbine assembly via an inlet port 16 located at the center of the inner rotor 10 after transitting an inlet duct 18. After entering the inner rotor, fluid flows radially outward from the center via the radial passageways 12, where it exits through liquid nozzles 14 located on the periphery of the inner rotor 10 at the outer terminus of each of the radial passageways 12 and substantially perpendicular to the passageways 12. This combination, when mechanically driven, constitutes a velocity pump or inner rotor assembly 20 with the incoming fluid flowing in a direction perpendicular to the plane of FIG. 1, through the inlet port 16, outward via the radial passageways 12, and thence through the liquid nozzles 14, thus imparting a resisting torque to the inner rotor assembly 20. Upon leaving the velocity pump rotor 10 via the liquid nozzles 14, the hot fluid enters an annular zone, or flow channel, 22 through which it flows before entering the outer continuous flow centrifugal rotor 24. As a result of radial acceleration, the fluid then enters a second set of radial passageways 26 which are located in the outer rotor 24 running from the outer rotor's inner surface to its periphery, where they terminate in combination liquid and two-phase steam nozzles, 28 and 30 which are substantially perpendicular to the passageways 26. The lateral areas of the VPRT are enclosed in a suitable housing 32 so as to form fluid-bearing conduits of the annular zone 22 and various radial passageways. The various seals and other components necessary for the formation of leak-proof ducts, together with the housing assembly 32, are fabricated from suitable materials utilizing fabrication techniques well within the skills of the art.

Hot fluid at or above its saturation pressure is admitted at the center of the inner rotor 10. The velocity pump serves the purpose of bringing the angular velocity of the hot fluid up to a value equal to $\Omega$ which is the angular velocity of the outer rotor 24 when the fluid passes from the velocity pump 20 to the outer rotor 24. For the case of a saturated liquid inlet, one-half of the magnitude of the velocity of the fluid in the inter-rotor annular zone 22 is due to the initial fluid flow as it enters the nozzles 14 while the other half is due to a velocity increase in liquid nozzles 14 on the periphery of the inner rotor 10. The angular velocity ratio between the pump rotor 10 and the turbine rotor 24 is selected so that the velocities of the nozzle effluent in the annular zone 22 and the liquid rotating within the inside surface of the outer rotor 24 are equal. This velocity ratio ranges from 0.5 for a saturated liquid inlet condition to a lesser value for compressed liquid inlet conditions. Fluid flowing in the inter-rotor annular zone 22 traveling at the same angular velocity, $\Omega$, as the outer rotor 24 will be at its saturation pressure. Therefore, any head pressure in excess of the fluid's saturation value at the velocity pump's inlet 16 will be utilized in bringing the fluid up to the angular velocity Ω. The liquid nozzles 28 in the outer rotor 24 recover work added to the fluid in the outer rotor's radial passageways 26 in the form of head and kinetic energy increase, while reducing the fluid's pressure back to its saturation value. Thrust is actually produced in the steam nozzles as the fluid is flashed to the exit pressure. This thrust provides the power to drive the inner rotor 10 via an interconnecting drive means, thus producing a net turbine shaft output.

Figure 9:
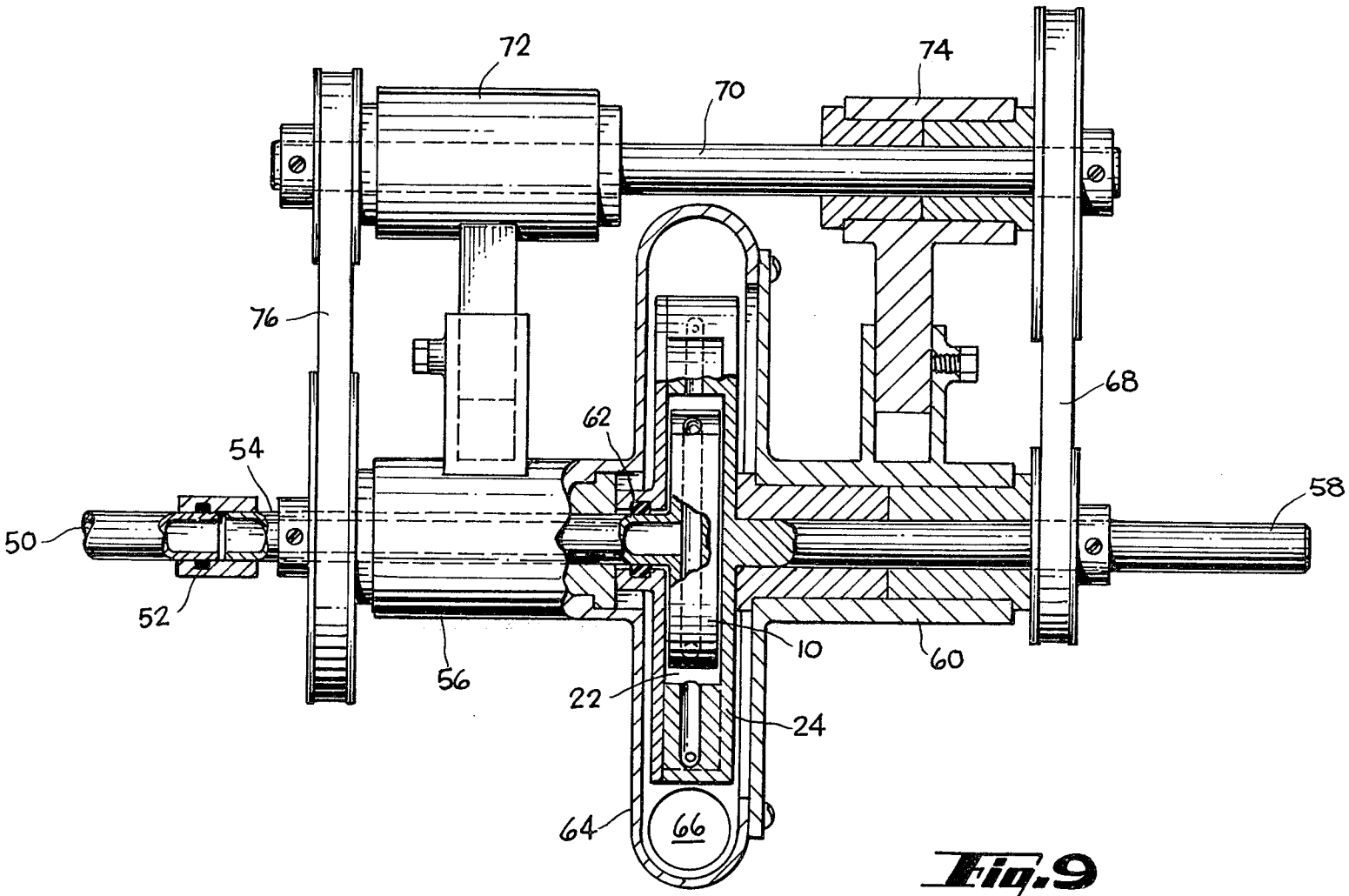
FIG. 9 is a view of the rotor shafts and drive assembly of the velocity pump reaction turbine.

Any of a number of the more common interconnecting shaft drive means currently available could be utilized in driving the inner rotor 10 by means of the outer rotor 24. One embodiment of the rotor shafts and drive assembly is shown in FIG. 9. The fluid enters through inlet pipe 50, passing through inlet seal 52, in inner rotor shaft 54 which rotates on bearing 56. The shaft 54 is connected to the inner rotor 10. The fluid enters the annular zone 22 between inner rotor 10 and outer rotor 24 which is connected to output shaft 58. The output shaft 58 rotates on bearing 60. The inner rotor 10 is enclosed in the outer rotor 24 with seal 62 allowing inner rotor 10 to rotate within outer rotor 24. The outer rotor is surrounded by case 64 with exhaust 66. The torque generated by output shaft 58 is transmitted to inner shaft 54 to drive inner rotor 10 by belting or gearing 68, connected to jack shaft 70 rotating on bearings 72 and 74 which drives belting or gearing 76 connected to inner shaft 54.

With the inlet to the radial passageways 26 at an intermediate radius from the VPRT's center, due to the pressure of the velocity pump 20, the relative velocity of the liquid entering the steam nozzles 30 is reduced. This, in turn, lowers the relative and absolute velocities of the vapor and liquid droplets leaving the two-phase steam nozzles 30. This reduction in "exit loss" provides a calculated 20 to 25% increase in engine efficiency over present radial outflow reaction turbine designs, as shown by the following analysis.

The inner rotor 10 of radius, r, rotates with an angular velocity, ω, while the outer rotor of radius, R, rotates with an angular velocity, Ω. Liquid of enthalpy, h, enters the center rotor 10 through the inlet port 16 and is pumped outward. The pump work is $$\int \frac{dp}{\rho} = \int_o^r r\omega^2 dr = \frac{r^2\omega^2}{2} \tag{1}$$

where p=pressure exerted on fluid in inner rotor
ρ=density of fluid
r=radius of inner rotor
ω=angular velocity of inner rotor.

Hence, the ideal relative velocity leaving the center rotor is $$v_{1i} = \sqrt{2\left(\frac{r^2\omega^2}{2}\right)} = r\omega. \tag{2}$$

The absolute velocity is $$V_{1i} = v_1 + u_1 = r\omega + r\omega = 2r\omega \tag{3}$$

where $u_1$=tangential velocity of the inner rotor, and the power supplied to the velocity pump is $$P_{1i} = \dot{m}(r_1\omega_1)(2r\omega) = 2\dot{m}r^2\omega^2, \tag{4}$$

where $\dot{m}$ is the mass flow rate of fluid. Letting the nozzle velocity coefficient be $\eta_1$, we have $$v_1 = \eta_1 r\omega, \tag{5}$$

$$V_1 = (1+\eta_1)r\omega, \text{ and} \tag{6}$$

$$P_1 = \dot{m}(r\omega)(1+\eta_1)r\omega = \dot{m}(1+\eta_1)r^2\omega^2 \tag{7}$$

For the outer rotor, the ideal moment of momentum, $T_i$, is $$T_i = \dot{m}[2r^2\omega + R(v_{2i} - R\Omega)]. \tag{8}$$

$$v_{2i} = \sqrt{V_{is}^2 + \Omega^2(R^2 - r^2)} \tag{9}$$

where

R=distance from the center of the inner rotor to the steam nozzles in the outer rotor
Ω=angular velocity of outer rotor
$\dot{m}$=mass flow of fluid through outer rotor, where $V_{is}$ is the ideal velocity resulting from isentropic expansion of the fluid through the outer nozzle due to the enthalpy drop, $\Delta h_{is}$; hence, $$V_{is} = \sqrt{2\Delta h_{is}} \tag{10}$$

as if the nozzle were fixed in space. The term $\Omega^2(R^2-r^2)$ is the centrifugal head. Letting $\eta_2$ be the nozzle velocity coefficient of the outer nozzle, the actual relative velocity is $$v_2 = \eta_2\sqrt{V_{is}^2 + \Omega^2(R^2 - r^2)}. \tag{11}$$

Using equations (6) and (11), the actual moment of momentum is $$T = \dot{m}\left[(1+\eta_1)r^2\omega^2 + R\eta_2\sqrt{V_{is}^2 + \Omega^2(R^2 - r^2)} - R^2\Omega\right]. \tag{12}$$

The net power output of the system is $$P = T\Omega - P_1, \tag{13}$$

which is $$P = \dot{m}\left[(1+\eta_1)r^2\Omega\omega + R\Omega\eta_2\sqrt{V_{is}^2 + \Omega^2(R^2 - r^2)} - R^2\Omega^2 - (1+\eta_1)r^2\omega^2\right] \tag{14}$$

This reduces to $$P = \dot{m}\left[(1+\eta_1)r^2(\Omega\omega - \omega^2) + \right. \tag{15}$$

-continued $$R\Omega\eta_2\sqrt{V_{is}^2+\Omega^2(R^2-r^2)}-R^2\Omega^2\Bigg]$$

To find the optimum conditions, we set $$\partial P/\partial\omega=(1+\eta_1)r^2(\Omega-2\omega)=0. \quad (16)$$

Solving for $\omega$, we obtain $$\omega=\Omega/2. \quad (17)$$

This condition is also obvious from the continuity requirement that the liquid annulus must have the same tangential velocity as the inner surface of the outer rotor, i.e., $$v_1+u=r\omega+r\omega=r\Omega, \therefore \omega=\Omega/2. \quad (18)$$

Substituting equation (17) into equation (15), defining the velocity ratio as $V=R\omega$, and defining the quantity $\beta$ as $$\beta=R\Omega/V_{is}=U/V_{is}. \quad (19)$$

we have as the net power output of the system $$P=\frac{\dot{m}V_{is}^2}{2}\left[\left(\frac{1+\eta_1}{2}\right)\frac{r^2}{R^2}\beta^2+2\beta\eta_2\sqrt{1+\left(1-\frac{r^2}{R^2}\right)\beta^2}-2\beta^2\right], \quad (20)$$

and the gross engine efficiency of the VPRT is $$e_{VPRT}=\frac{P}{\frac{\dot{m}V_{is}^2}{2}}=\left(\frac{1+\eta_1}{2}\right)\frac{r^2}{R^2}\beta^2+2\beta\eta_2\sqrt{1+\left(1-\frac{r^2}{R^2}\right)}-2\beta^2. \quad (21)$$

Because the fluid remains in the liquid state through the expander, the inner nozzle is very efficient. Hence, without much loss in accuracy and generality, we can set $\eta_1\cong1.0$ so that Eq. (20) reduces to $$P\cong\frac{\dot{m}V_{is}^2}{2}\left[\left(\frac{r^2}{R^2}+2\right)\beta^2+2\beta\eta_2\sqrt{1+\left(1-\frac{r^2}{R^2}\right)\beta^2}\right] \quad (22)$$

and the engine efficiency is $$e_{VPRT}=\frac{P}{\frac{\dot{m}V_{is}^2}{2}}=\left(\frac{r^2}{R^2}-2\right)\beta^2+2\beta\eta_2\sqrt{1\pm\left(1-\frac{r^2}{R^2}\right)\beta^2}. \quad (23)$$

Figure 2:
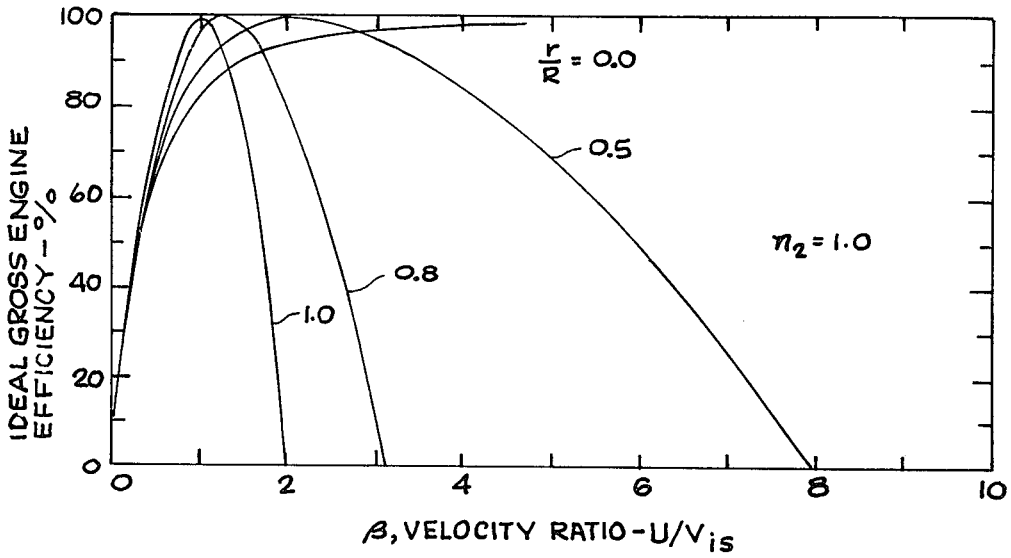
FIG. 2 is a plot of the ideal gross engine efficiency of the velocity pump reaction turbine as a function of the ratio of velocity of the outer rotor to the ideal velocity for 100% outer nozzle efficiency.
Figure 3:
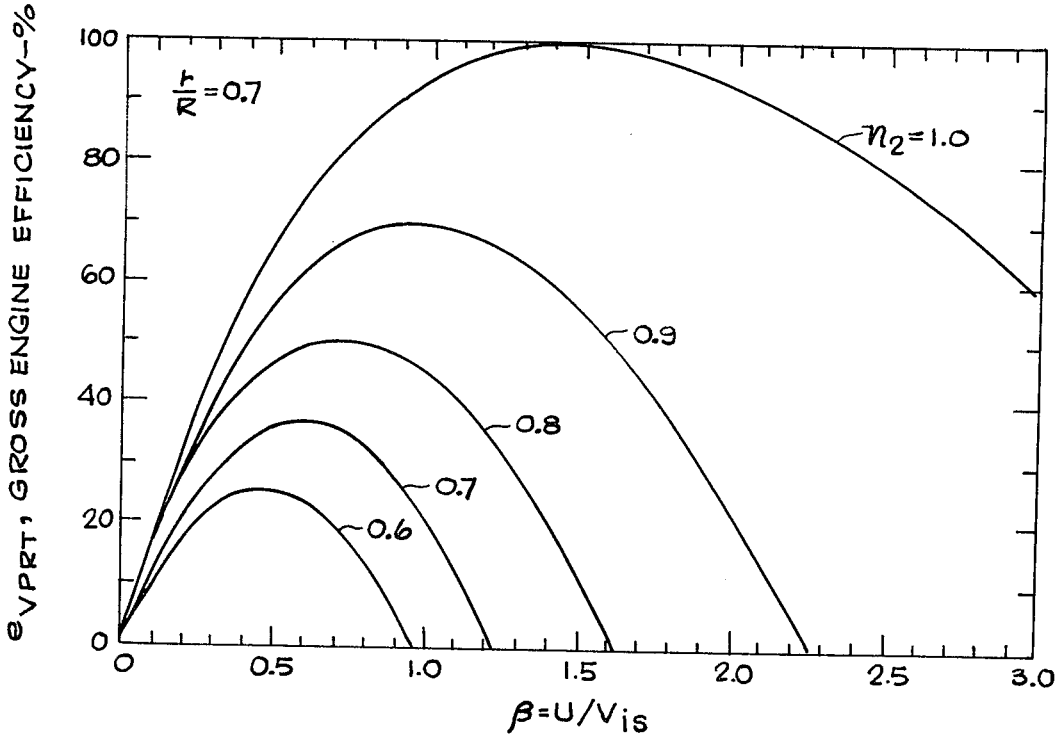
FIG. 3 shows gross engine efficiency of the velocity pump reaction turbine for imperfect nozzle efficiency.

The distinguishing feature of the subject invention is that adding a velocity pump allows maximum performance at finite velocity ratios, as shown in FIG. 2, which is a plot of Equation (23) with $\eta_2=1.0$. The effect of an imperfect nozzle ($\eta_2\neq1.0$) is shown in FIG. 3 for the specific case of $r/R=0.7$. It should be noted here that, of course, $r/R=1.0$ is not practicable, nor are nozzle coefficients greater than 0.9 likely in the rotating nozzle. These curves also show the reduction in the optimum velocity ratio to values much lower than 1.0. The advantages inherent in the velocity pump reaction turbine design embodied in this invention are readily apparent: lower tip speed, U, results in lower wheel stresses, which in turn reduces design problems and enhances turbine reliability.

Figure 4:
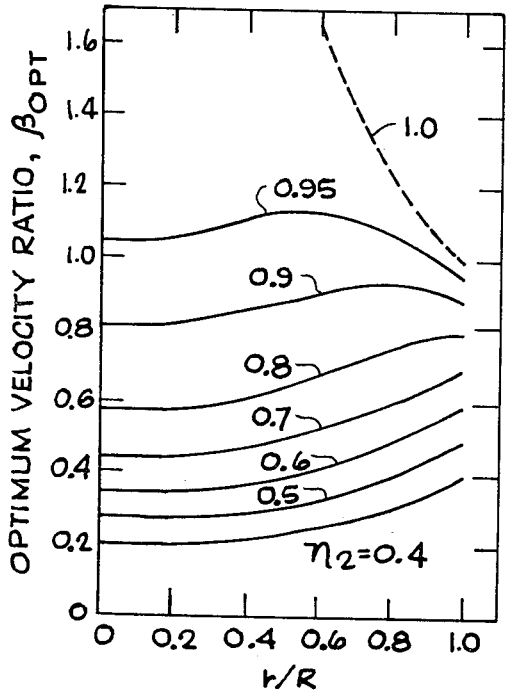
FIG. 4 shows the optimum velocity ratio for maximum engine efficiency of the velocity pump reaction turbine for various nozzle coefficients.
Figure 5:
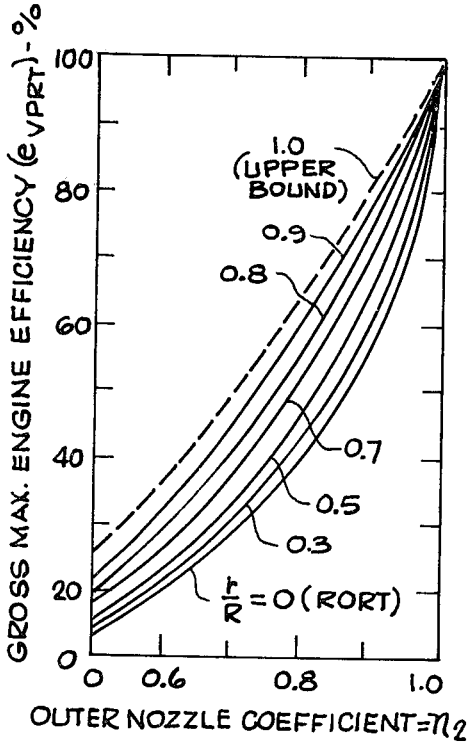
FIG. 5 shows gross maximum engine efficiency of the velocity pump reaction turbine as a function of outer nozzle efficiency.

For any given nozzle coefficient and any desired r/R, FIG. 4 gives the optimum velocity ratio, $\beta_{opt}$, for maximum engine efficiency. For example, with a nozzle coefficient of 0.8 and an $r/R=0.9$, FIG. 5 shows that the mechanical design must accommodate the increase in speed ratio from $\beta=0.58$ to $\beta=0.78$. This may be restrictive for higher enthalpy drops. However, these results show that the VPRT has the potential to be a significant improvement in the technology of liquid expanders, particularly for the lower temperature energy sources.

Figure 6:
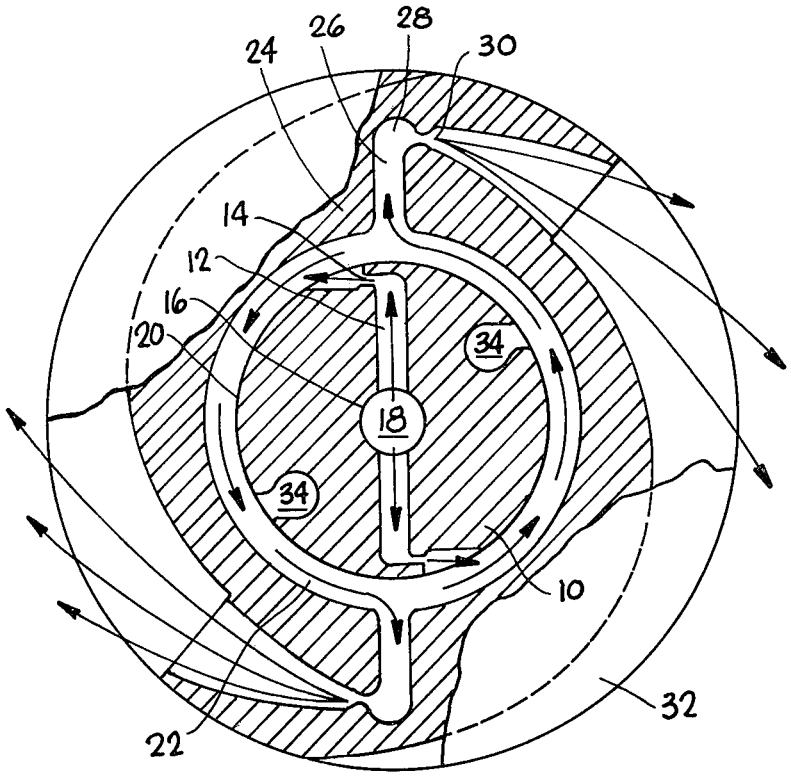
FIG. 6 is a cutaway cross-sectional view of the combination hydraulic/thermal reaction turbine.

Another embodiment of the present invention designed to take advantage of low temperature geopressured geothermal reservoirs is shown in FIG. 6. The configuration shown in FIG. 6, wherein like reference characters designate like or corresponding parts as shown in FIG. 1, incorporates several variations from the basic velocity pump reaction turbine design. Compressed liquid, as from a geopressured source, enters the system through the inlet port 16 at the center of the inner rotor 10, and travels radially outward via the radial passageways 12 and passes into the annular zone 22 after flowing through the liquid nozzles 14 located on the periphery of the inner rotor 10. In this embodiment, however, the inner rotor 10 is maintained stationary. Flow of the liquid through nozzles 14 results in a lowering of the liquid pressure to near the saturation value, thus converting liquid head pressure into kinetic energy. The liquid nozzle's radius, r, is selected so that the velocities of nozzle effluent and liquid rotating within the inter-rotor annular space 22 are equal. Positioned on the outer surface of the inner rotor 10 are gas recovery ports 34. A gas, such as methane, which has come out of solution due to a pressure reduction in the liquid nozzles 14, will collect in these ports and can be recovered. By virtue of the moving liquid's centrifugal force, the less dense gas will tend to collect in the portion of the annular zone 22 closest to the inner rotor 10. By removing trapped gas from the recovery ports 34 at a rate consistent with the amount coming out of solution, a constant pressure can be maintained to permit stable operation of the turbine. The trapped gas is removed by bleeding off with a flow control valve.

An outer rotor 24 forms the outer boundary of the annular zone 22. The outer rotor 24 contains two or more combination liquid nozzles 28 and two-phase steam nozzles 30. The liquid head present in the compressed liquid at the inlet port 16 is used to bring the liquid up to speed at an intermediate radius, r', without any expenditure of work by the outer rotor 24. An increase in both kinetic energy and head has been added to the liquid when it arrives at the outer liquid nozzle 28 radius, R. This added work, along with a portion of the original head, is recovered by work done by the outer liquid nozzle thrust. The remaining portion of the original head (minus losses) is present as kinetic energy of the outer liquid nozzle effluent. The kinetic energy is due to the tangential velocity of the liquid in the direction of motion of the outer rotor 24. This energy, together with a portion of the thermal energy, is then converted into work when the flow velocity through the steam nozzles 30 reaches an absolute velocity of zero. This will occur over an axial zone, due to slip between the phases, beginning first with vapor and ending with the larger droplets. Part of the remaining thermal energy is then converted into work as the phases are accelerated to their exit velocities. Thus the turbine functions as both a hydraulic and two-phase steam turbine.

In this geopressure combination turbine (GCT) embodiment of the present invention which facilitates gas removal, the angular velocity, $\omega$, of the inner rotor may be written as $$\omega = 0 = \tfrac{1}{2}\left(1 - \frac{1}{\frac{r^2}{R^2}\beta^2 Z}\right). \tag{24}$$

where

Z=ratio of available thermal energy to available hydraulic energy $$Z = J\Delta h_{is}/H \tag{25}$$

with $J$ = mechanical equivalent of heat
= 778 ft-lb/Btu $\Delta h_{is}$=isentropic enthalpy drop occurring through the outer nozzle only $H$ = the head pressure $$= \frac{\Delta P_G}{\gamma} = \frac{\text{overpressure due to geopressure}}{\text{specific weight of the fluid}}.$$

The velocity ratio, $\beta$, can thus be written as $$\therefore \beta^2 = \frac{1}{\frac{r^2}{R^2} Z}. \tag{26}$$

Substituting Equation 24 into the expression for the engine efficiency of the geopressure velocity pump reaction turbine, we have $$e_{GCT} = \frac{2}{1+Z}\left[1 - Z\beta^2 + \beta\eta_2\sqrt{Z^2(1+\beta^2) - Z}\right]. \tag{27}$$

Figure 7:
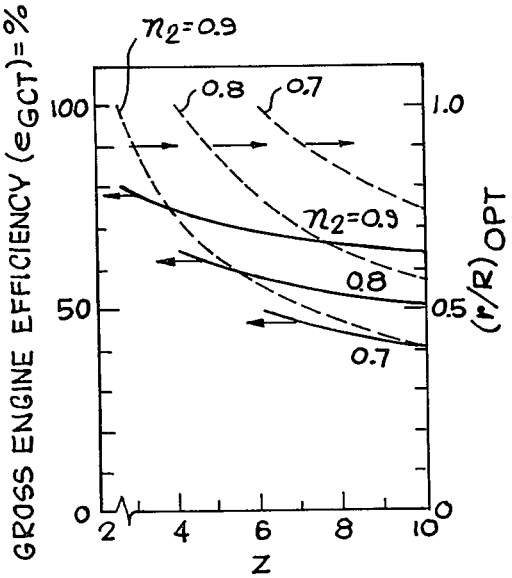
FIG. 7 shows geopressure combination turbine performance as a function of the ratio of available thermal energy to available hydraulic energy for various outer nozzle velocity coefficients.
Figure 8:
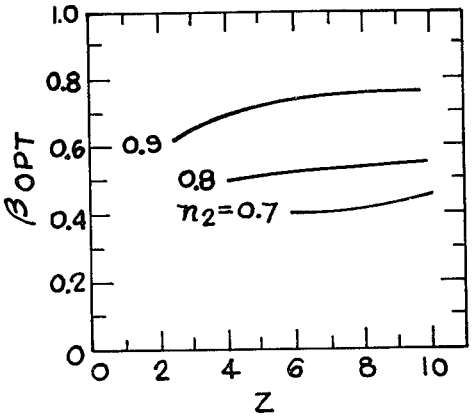
FIG. 8 shows the optimum velocity ratios for the geopressure combination turbine.

The optimum speed ratio, $\beta_{OPT}$, can be found by setting $$\partial e_{GCT}/\partial\beta_{OPT} = 0 \tag{28}$$

and solving for $\beta_{OPT}$, which results in $$\beta_{OPT} = \left(\frac{U}{V_{is}}\right)_{OPT} = \sqrt{\left(\frac{Z-1}{2Z}\right)\left(\frac{1}{\sqrt{1-\eta_2^2}} - 1\right)} \tag{29}$$

as the optimum speed ratio for maximum efficiency. From Equation 24, the corresponding value of r/R can be found as $$\left(\frac{r}{R}\right)_{OPT} = \frac{1}{\beta_{OPT}\sqrt{Z}}, \tag{30}$$

which gives the only value of r/R for the maximum efficiency. The value Z is specified by the known thermal and hydraulic components of the geopressured wellhead product, and $\eta_2$ is given. Therefore, the optimum speed ratio can be determined from Equation 29. Substituting the value thereby arrived at into Equations 27 and 30, we can solve for the maximum efficiency, as well as for r/R. FIG. 7 shows efficiency over a range of Z for three cases: $\eta_2$=0.9, 0.8, and 0.7. FIG. 8 shows the optimum speed ratio for the same values of $\eta_2$. There is no gain in efficiency over the basic VPRT design, although the machine is simpler with its fixed inner rotor.

Thus it is apparent that there has been provided, in accordance with the invention, a family of expanders for the expansion of liquids to produce shaft work at potential engine efficiencies of 50–70%. The use of this invention as a liquid expander between the two separation stages in a double-flash system results in an increase in power output of approximately 15–20% over that currently available. This invention is especially important for utilizing low temperature energy sources such as those encountered in geothermal deposits, solar-heated fluids, and waste heat sources from industrial processes. Thus the present invention fully satisfies the objects, aims, and advantages set forth above. While the invention has been described in conjunction with the specific embodiments thereof, it is evident that many alternatives, modifications, and variations will be apparent to those skilled in the art. It is intended to embrace all such alternatives, modifications, and variation as fall within the spirit and broad scope of the appended claims.

What is claimed is:

1. A velocity pump reaction turbine having the operating characteristic of maximum efficiency at finite speed, for converting thermal energy from a hot liquid at or above its saturation pressure, comprising:

a first shaft;

an inner velocity pump rotor connected to the first shaft and rotating therewith, the velocity pump rotor having an inlet port at the center, a plurality of first radial passageways extending from the inlet port, and a plurality of first liquid nozzles located on the periphery of the pump rotor at outer ends of the first radial passageways;

a second shaft;

an outer reaction turbine rotor connected to the second shaft and rotating therewith, and positioned concentrically around the velocity pump rotor, the reaction turbine rotor having a plurality of second radial passageways extending from an inner surface of the reaction turbine rotor, and a plurality of second nozzles located on the periphery of the turbine rotor at outer ends of the second radial passageways;

a housing enclosing the pump rotor and concentric turbine rotor, and defining therewith an annular space therebetween; and interconnecting drive means between the first and second shafts to drive the pump rotor from the turbine rotor in the same direction as the turbine rotor and at a speed at which hot liquid at or above its saturation pressure which is flowed into the inlet port of the pump rotor is pumped through the first radial passageways and first liquid nozzles into the annular space with a fluid velocity matching the tangential velocity of the outer turbine rotor at its inner surface.

2. The turbine of claim 1 wherein the second nozzles each comprise a converging liquid nozzle opening into a diverging two-phase steam nozzle.

3. The turbine of claim 2 wherein the first and second nozzles are directed substantially tangentially to the pump rotor and turbine rotor, respectively.

4. The turbine of claims 1, 2 or 3 for use with hot liquid at saturation pressure wherein the pump rotor is driven by the turbine rotor through the interconnecting drive means at an angular velocity of about one-half the angular velocity of the turbine rotor.

5. The turbine of claims 1, 2 or 3 for use with hot liquid at greater than saturation pressure wherein the pump rotor is driven by the turbine rotor through the interconnecting drive means at an angular velocity of less than one-half the angular velocity of the turbine rotor.

6. The turbine of claims 1, 2 or 3 adapted to be driven by a hot liquid at or above its saturation pressure from a geothermal source.

* * * * *